US007439473B2

(12) United States Patent
Lewin

(10) Patent No.: US 7,439,473 B2
(45) Date of Patent: Oct. 21, 2008

(54) METHOD AND ARRANGEMENT FOR SUPPORTING VERTICALLY DEPENDING ELECTRICAL RESISTANCE ELEMENTS

(75) Inventor: Thomas Lewin, Hallstahammar (SE)

(73) Assignee: Sandvik Intellectual Property AB, Sandviken (SE)

( * ) Notice: Subject to any disclaimer, the term of this patent is extended or adjusted under 35 U.S.C. 154(b) by 154 days.

(21) Appl. No.: 10/562,610

(22) PCT Filed: Jun. 29, 2004

(86) PCT No.: PCT/SE2004/001047

§ 371 (c)(1),
(2), (4) Date: May 27, 2006

(87) PCT Pub. No.: WO2005/003667

PCT Pub. Date: Jan. 13, 2005

(65) Prior Publication Data

US 2006/0237443 A1 Oct. 26, 2006

(30) Foreign Application Priority Data

Jul. 3, 2003 (SE) ..... 0301970

(51) Int. Cl.
*H05B 3/44* (2006.01)
*H05B 3/62* (2006.01)

(52) U.S. Cl. ..... 219/544; 219/202; 219/530; 219/531; 219/552; 219/553; 373/132; 373/133; 373/134; 338/234; 338/235; 338/236; 338/237; 392/480; 392/497; 392/488; 392/503

(58) Field of Classification Search ..... 219/202, 219/544, 550, 542, 539, 552–3; 373/117, 373/132–4; 338/234–7; 392/480, 488, 497, 392/503

See application file for complete search history.

(56) References Cited

U.S. PATENT DOCUMENTS

| | | | | |
|---|---|---|---|---|
| 4,179,603 A | | 12/1979 | Zeigler et al. | 219/538 |
| 4,392,052 A | * | 7/1983 | Magnusson et al. | 219/532 |
| 5,473,141 A | * | 12/1995 | Makris et al. | 219/544 |

FOREIGN PATENT DOCUMENTS

| | | |
|---|---|---|
| FR | 2643533 | 8/1990 |
| GB | 1509102 | 4/1978 |

* cited by examiner

*Primary Examiner*—Shawntina Fuqua
(74) *Attorney, Agent, or Firm*—Alfred J. Mangels

(57) ABSTRACT

A method of supporting vertically hanging electrical resistance elements for heating furnaces or ovens in industrial operations. Each resistance element includes current-conducting legs that extend downward and upward a number of times, and the element includes along its length a number of ceramic discs that are provided with through-holes through which respective element legs extend. The upper part of the element merges with terminals that are connected to a source of electric current. The element is supported by at least one of the uppermost ceramic discs, wherein the uppermost ceramic disc supporting the element is placed in the insulation of the furnace roof above the underside of the roof. The legs of the element are short circuited at a location slightly or somewhat beneath the underside of the furnace roof with the aid of short circuiting plates.

10 Claims, 1 Drawing Sheet

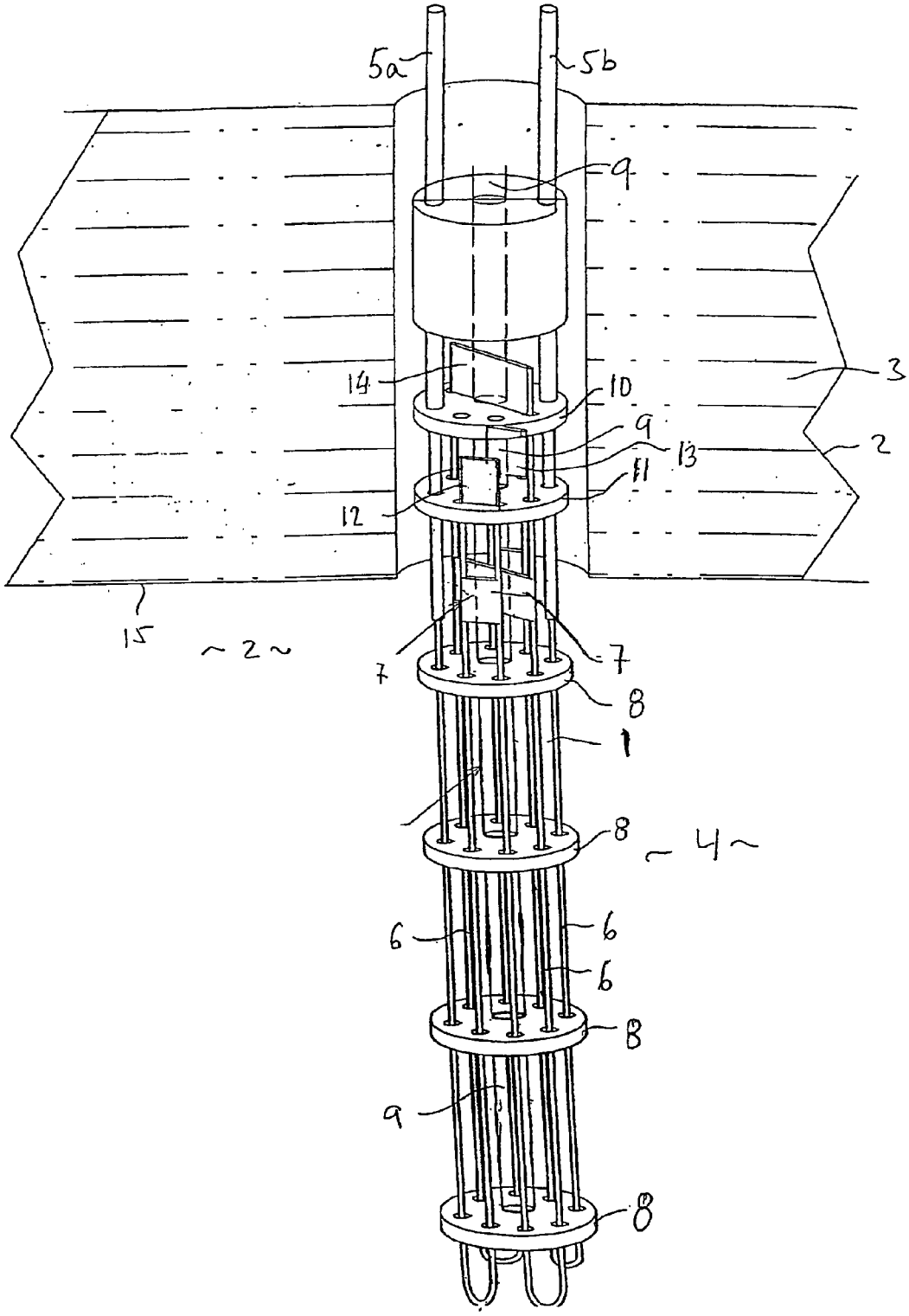
5a
5b
9
14
10
3
9
13
2
11
12
15
~2~
7
7
8
1
8
~4~
6
6
6
8
9
8

METHOD AND ARRANGEMENT FOR SUPPORTING VERTICALLY DEPENDING ELECTRICAL RESISTANCE ELEMENTS

BACKGROUND OF THE INVENTION

1. Field of the Invention

The present invention relates to a method and an arrangement for supporting vertically depending electrical resistance elements.

2. Description of the Related Art

Such resistance elements are used primarily to heat industrial furnaces or ovens. Each element includes current conducting legs that run downwards and upwards a number of times. The top of the element merges with a number of terminals that are connected to one more sources of electric current. The element thus hangs from the roof of the furnace and extends downwards in operation. The legs are subjected to strong thermal variations in operation, due to the power developed therein. This variation results in bending or twisting of individual legs in the element as the temperature changes. Consequently, the element is provided along its length with a number of ceramic discs that include through-penetrating holes through which respective element legs extend. These ceramic discs are intended to hold the legs of the element apart and out of contact with one another. Mutual contact of the legs would cause the element to short circuit, resulting in serious damage, if not destruction, of the resistance element.

The uppermost ceramic disc or the uppermost discs may also serve to support the weight of the resistance element. According to the present state of the art, this is achieved by coupling pairs of legs together with the aid of current conducting plates which rest on the uppermost ceramic disc or on the uppermost discs, depending on the geometry of the resistance element concerned. Legs thus extend pair-wise through a ceramic suspension disc and are joined together on the upper side of said disc through the medium of such a current conducting plate and supported in this way by the ceramic disc.

The power developed in the legs is often very high. Typical powers developed in the legs of a resistance element in industrial operation can be in the order of 20-50 kW. The resistance element is often driven cyclically, meaning that the temperature in the vicinity of the ceramic plates will vary over a wide temperature range in the space of time.

This heavy thermal load in combination with the mechanical load borne by the supportive ceramic discs results in the formation of cracks in said discs and finally in fracturing of the discs. When this occurs, the resistance element will no longer be supported by the broken discs and will collapse down into the furnace, thereby resulting in significant repair costs.

A typical life span of a supporting ceramic disc is of the order of three to six months.

An industrial furnace may include a considerable number of resistance elements, for example several hundred. This means that serious costs are often incurred in changing or replacing supportive ceramic discs. It is therefore desirable to find a way of increasing the useful length of life of such discs.

SUMMARY OF THE INVENTION

Accordingly, the present invention relates to a method and to an arrangement for supporting vertically hanging electrical resistance elements for heating furnaces or ovens in industrial operations. Each element includes current conducting legs that run downwards and upwards a number of times, wherein the resistance element includes along its length a number of ceramic discs that are provided with holes through which respective element legs extend. The upper part of the element merges with terminals that are connected to a source of electric current. The element is supported by at least one of the uppermost of the ceramic discs, and the uppermost ceramic disc by which the element is supported is placed in the roof insulation of the furnace above the underside of the roof. The legs of the element are short circuited at a location slightly or somewhat beneath the underside of said roof with the aid of short circuiting plates.

The invention also relates to an arrangement for carrying out the method.

BRIEF DESCRIPTION OF THE DRAWING

The invention will now be described in more detail with reference to a non-limiting exemplifying embodiment thereof and also with reference to FIG. 1, which shows an elevational view of an embodiment of an electrical resistance support arrangement for supporting vertically depending resistance elements.

DESCRIPTION OF THE PREFERRED EMBODIMENTS

FIG. 1 illustrates a resistance element assembly 1 according to the present invention, mounted in a furnace 2. The resistance element assembly 1 extends through the roof insulation 3 of the furnace 2 and down into the heated furnace volume 4. The temperature in the heated volume 4 is extremely high and sometimes varies cyclically in the operation of the furnace. The temperature diminishes gradually upwards in the insulation 3 as seen in the FIGURE, down to essentially room temperature above the upper edge of the insulation 3.

The resistance element assembly 1 is driven through the agency of two terminals 5*a* and 5*b* that are connected to an external source of electric current (not shown). The resistance element assembly 1 includes along its length a number of legs 6 which extend down into the heated volume 4 of the furnace and up again to the insulation 3 of the furnace 2. The legs 6 are coupled together in pairs with the aid of a number of connecting plates 7, which are preferably made of the same material as the legs themselves. These connecting plates 7 are situated below the lower surface 15 of the furnace roof.

One of the legs 6 is also coupled to the input terminal 5*a* and another of the legs 6 is coupled to the output terminal 5*b*. This allows current to flow in through the input terminal 5*a*, through all legs 6 and finally out through the output terminal 5*b*.

The number of terminals 5*a*, 5*b* may be varied for different purposes, for instance to enable furnace power to be controlled. The terminals 5*a*, 5*b* may also be connected to several external sources of electric current.

The legs 6 are preferably formed from FeCrAl.

In order to prevent short circuiting between the legs 6 when the temperature varies, a number of disc-shaped ceramic spacers 8 are spaced longitudinally along the length of the resistance element assembly 1, said ceramic spacers 8 being held in place by a central rod 9 extending through the resistance element assembly 1.

The ceramic spacers 8 are preferably formed from $Al_2O_3$, $SiO_2$, or a mixture thereof, these materials being electrically insulating.

The two uppermost ceramic discs 10, 11 are placed above the upper inner surface of the heated volume 4 of the furnace 2, and above lower surface 15 of the furnace roof, within the insulation 3 of the furnace roof 2. These uppermost ceramic discs 10, 11 serve to support the weight of the element assembly 1, in addition to functioning as spacer means between the legs 6. This weight supporting function is achieved by virtue of the legs 6 being coupled pair-wise with the aid of a number of supporting plates 12, 13, 14, which rest on the upper surfaces of respective ones of uppermost ceramic disks 10, 11.

Thus, as a result of the conducting plates 7 present in the heated furnace volume 4, much less current will flow through that upper part of the legs 6 situated in the furnace roof insulation 3 than that which flows through those lower parts of the legs 6 that are situated in the heated furnace volume 4 of the furnace 2.

Only the current that flows from the input terminal and through a leg down through the insulation 3 of the furnace 2 and the current that flows from a leg through the insulation 3 of the furnace 2 and out through the output terminal contributes to the thermal development of power in the leg portions that are within the region of the insulation 3 of the furnace 2.

Because the ceramic plates 12 are formed from an electrically insulating material, the power developed by the current passing through the legs and through the ceramic plates 12, in other words the current flowing through the legs above the upper surface of the heated volume 4 of the furnace 2, will be negligible.

The thermal load on the uppermost, supportive ceramic discs 10, 11 is greatly reduced by virtue of the temperature in the insulation 3 of the furnace 2 being much lower than the temperature of the heated volume 4 of the furnace 2. The non-supporting ceramic discs 8 remain under thermal loading. Thus, the present invention circumvents the problem relating to the application of both thermal and mechanical loads to supportive ceramic discs.

The thermal load on the supportive ceramic discs 10, 11 can be reduced still further, by placing said discs above the upper surface of the insulation 3 of the furnace 2, in other words externally of the furnace and therewith under essentially room temperature conditions.

In this way, the present invention increases the life span of the supportive ceramic discs from the normal three to six months applicable in the case of the present state of the art to from two to four years, thereby greatly reducing the operating costs of this type of resistance element in industrial applications.

Moreover, because the thermal load on the supportive discs is reduced significantly, the discs can be given smaller dimensions according to the present invention than has been possible hitherto. In turn, this enables resistance elements to be given geometries that are novel or expanded with respect to geometries applicable to the present state of the art. Alternatively, larger resistance element assemblies can be constructed with the aid of the present invention due to the fact that the supportive discs are now able to withstand a greater load as a result of the substantial reduction in the thermal load on the discs.

Furthermore, the inventive electrical resistance element assembly can be operated with a higher power than was possible with resistance elements according to the present state of the art, for the same reasons as those mentioned above.

Although the invention has been described above with reference to a number of embodiments thereof, it will be understood that those embodiments can be varied with respect to the type of element concerned, for instance.

The present invention is not therefore to be considered to be restricted to the embodiments indicated above since variations can be made within the scope of the accompanying claims.

What is claimed is:

1. A method for supporting vertically hanging electrical resistance elements for heating furnaces or ovens in industrial operations, wherein each resistance element includes current-conducting legs that extend upwardly and downwardly, said method comprising the steps of: providing a resistance element assembly including a plurality of vertically-extending resistance element legs; laterally spacing the resistance element legs from each other by a plurality of ceramic support discs that each include a plurality of through-penetrating holes through which respective resistance element legs extend, wherein upper parts of at least two resistance element legs merge with terminals that are connected to a source of electric current; vertically supporting the weight of the resistance element assembly by at least one uppermost ceramic support disc; positioning the at least one uppermost ceramic support disc laterally adjacent a layer of insulation at a furnace roof and above an underside of the insulation layer, whereby the at least one uppermost ceramic support disc is maintained at a lower temperature than a furnace interior temperature; and interconnecting legs of the resistance element at a location below the underside of the insulation layer with conductive connecting plates for reducing current flow through parts of the resistance element legs that are above the connecting plates.

2. A method in accordance with claim 1, including the step of forming the legs from FeCrAl.

3. A method in accordance with claim 1, including the step of forming the at least one ceramic support disc from at least one of Al2O3, $SiO_2$, and mixtures thereof.

4. A method in accordance with claim 3, including the step of positioning uppermost ceramic support discs for supporting the weight of the resistance element assembly at two levels each laterally adjacent to the insulation layer.

5. A method in accordance with claim 1, including the step of positioning ceramic support discs above an upper surface of the furnace roof.

6. An arrangement for supporting vertically hanging electrical resistance elements for heating furnaces or ovens in industrial operations, wherein each resistance element includes current-conducting legs that extend upwardly and downwardly, said arrangement comprising: a resistance element assembly having a plurality of vertically-extending resistance element legs; a plurality of ceramic support discs that each include a plurality of through-penetrating holes through which respective resistance element legs extend for laterally spacing the resistance element legs from each other, wherein upper parts of at least two resistance element legs merge with terminals that are connected to a source of electric current; at least one uppermost of said ceramic support discs is positioned laterally adjacent a layer of insulation at a furnace roof and above an underside of the insulation layer to verticall support the weight of the resistance element assembly, whereby the at least one uppermost ceramic support disc is maintained at a lower temperature than a furnace interior temperature; and wherein legs of the resistance element are interconnected at a location below the underside of the insulation layer with conductive connecting plates for reducing current flow through parts of the resistance element legs that are above the connecting plates.

7. An arrangement in accordance with claim 6, wherein the legs are formed from FeCrAl.

8. An arrangement in accordance with claim 6, wherein the ceramic support discs are formed from one of $Al_2O_3$, $SiO_2$, and mixtures thereof.

9. An arrangement in accordance with claim 6, wherein uppermost ceramic support discs for vertically supporting the weight of the resistance element assembly are positioned at two levels each laterally adjacent to the insulation layer.

10. An arrangement in accordance with claim 6, wherein the at least one ceramic support disc is located above an upper surface of the furnace roof.

* * * * *